US005921211A

United States Patent [19]

Salvisberg

[11] Patent Number: 5,921,211

[45] Date of Patent: Jul. 13, 1999

[54] ADJUSTABLE INTERLOCKING IGNITION ROTOR DEVICE

[76] Inventor: Marc W. Salvisberg, 855 San Anselmo Ave., San Anselmo, Calif. 94901

[21] Appl. No.: 09/148,967

[22] Filed: Sep. 5, 1998

[51] Int. Cl.[6] ..... F02P 1/00

[52] U.S. Cl. ..... 123/146.5 A; 123/612; 200/19 DR

[58] Field of Search ..... 123/146.5 A, 612; 200/19 DR

[56] References Cited

U.S. PATENT DOCUMENTS

| | | | |
|---|---|---|---|
| 3,776,211 | 12/1973 | Droke et al. | 123/146.5 A |
| 4,057,045 | 11/1977 | Stellwagen | 123/146.5 A |
| 4,089,316 | 5/1978 | Padgitt | 123/146.5 A |
| 5,233,960 | 8/1993 | Kato | 123/146.5 A |
| 5,402,761 | 4/1995 | Dechellis | 123/146.5 A |

*Primary Examiner*—Tony M. Argenbright
*Assistant Examiner*—Mahmoud M. Gimie
*Attorney, Agent, or Firm*—Cherskov & Flaynik

[57] ABSTRACT

An adjustable interlocking ignition rotor device 10 includes a first member 12 having a plurality of orifices 34 radially positioned around the axis of the first member 12, a second member 14 having a plurality of orifices 56 radially positioned around the axis of the second member 14, and an index screw 16 to secure the first member 12 to the second member 14. The first and second members 12 and 14 are secured to a base portion of a distributor assembly or one end of a crankshaft to adjust the timing of an internal combustion engine. The engine timing is easily adjusted to an advanced or retarded position in relation to a zero degree setting by counting from a zero degree orifice 78 and 80 in both the first and second members 12 and 14 in a corresponding advanced or retarded direction, a quantity of orifices corresponding in number to a predetermined degree of engine timing. The selected orifices in the first and second members 12 and 14 are aligned and an index screw 16 is inserted thereby securing the position of the first member 12 in relation to the second member 14.

13 Claims, 10 Drawing Sheets

ADJUSTABLE INTERLOCKING IGNITION ROTOR DEVICE

BACKGROUND OF THE INVENTION

1. Field of the Invention

The present invention relates to adjustable ignition rotors and, more particularly, to an adjustable interlocking ignition rotor utilized in a distributor assembly for setting the timing of an automobile or motorcycle engine.

2. Background of the Prior Art

An internal combustion engine requires quick, accurate and adjustable timing for the firing of the combustible mixture in a piston chamber to obtain maximum power and performance from an engine irrespective of the engine being used for automobiles or motorcycles. The timing is set by a distributor assembly or triggering devices such as pick-up coils to fire spark plugs at different time intervals when the piston stroke provides optimum efficiency and power. An adjustable ignition rotor is a rotating component in the distributor assembly that allows engine timing to be slightly varied to optimize engine power at predetermined engine revolutions per minute (R.P.M.). When utilized to optimize engine power in motor vehicles that do not use distributor assemblies such as motorcycles, the rotor is secured to a rotating crankshaft via a locking key that is integrally mounted to one end of the crankshaft.

Engine timing is set by advancing or retarding (rotating clockwise or counterclockwise) the rotor setpoint from a zero degree position to one or more degrees from the zero degrees setting in either direction. The typical rotor consists of a lower portion that engages a distributor shaft, the lower portion including a zero degree mark scribed thereon, an upper portion having a plurality of timing adjusting marks scribed thereon corresponding to increments of engine timing, central orifices through both upper and lower portions to allow a distributor shaft to pass therethrough, and arcuate adjustment slots oppositley positioned in the upper portions of the rotor. The slots removably receive setscrews that are ultimately secured to the lower portion. The slots are dimensioned to allow the upper portion to rotate (the setscrews being inserted through the slots, loosened, and secured to the lower portion) sufficiently to position any of the scribed marks on the upper portion adjacent to the zero scribe mark on the lower portion thereby selecting engine timing to an advanced or retarded setting.

FIGS. 1–5 illustrate a typical prior art device with FIG. 1 depicting a exploded top, right perspective view, FIG. 2 depicting an exploded bottom, right perspective view, FIG. 3 depicting an exploded top, left perspective view, FIG. 4 depicting a bottom view of the lower portion and FIG. 5 depicting a bottom view of the upper portion.

One problem with the prior art device is that the setscrews tend to loosen over time due to engine vibrations thereby allowing engine timing to vary from optimum performance. Another problem is that a paralax phenomenon is generated. More Specifically, the scribed marks used to align the upper and lower portions can be very difficult to align due to small, tight marks and varying angles of view a person might have when adjusting the marks on the rotor while the rotor is joined with the distributor shaft or when the rotor is joined to one end of a crankshaft.. Another problem is that it is very difficult to maintain the position of aligned scribe marks while tightening the setscrews. Still another problem is that the setscrews have a tendency to come completely out of the threaded orifice in the lower portion, then fall into the engine or distributor assembly and become difficult to retrieve. Yet another problem with prior art rotors is that they are time consuming to adjust due to the very small rotation distances a mechanic must cope with when varying engine timing by as little as one degree or less.

A need exists in the art for a device that reduces time for setting engine timing. Also a need exists for maintaining the setting of an engine's timing, preventing the loss of setscrews while adjusting engine timing, and increasing accuracy and consistency when aligning scribed marks on the upper and lower portions of a rotor device in a distributor assembly or when joined to one end of a crankshaft.

SUMMARY OF THE INVENTION

It is an object of the present invention to overcome many of the disadvantages associated with prior art adjustable ignition rotor devices.

It is another object of the present inventions to provide a device that provides quick variation of the engine timing. A feature is a plurality of orifices in upper and lower members of the device. An advantage of the device is the quick alignment of orifices in the upper and lower members that corresponds to a predetermined engine timing setting.

Yet another object of the present invention is to prevent a setscrew from falling from the device and into an engine or distributor assembly. A feature of the device is threaded orifices in the upper and lower members. An advantage of the device is a secured set screw when extracted from the lower member.

Still another object of the present invention is to provide one degree or less accuracy in the setting of engine timing. A feature of the device is positioning the orifices in the lower member such that the distance separating adjacent orifice axes corresponds to varying engine timing a predetermined unit of degree. An advantage of the device is the deletion of difficult to view scribed markings requiring alignment (paralax phenomenon), and the addition of easily viewed orifices that are easily aligned by inserting an indexing screw through preselected, adjacently positioned orifices.

Another object of the present invention is to provide a device that quickly sets engine timing in an advanced or retarded position a predetermined number of degrees. A feature of the device is multiple orifices in the upper and lower members in advanced and retarded positions from a zero degree orifice set to one or less of a degree increments. An advantage of the device is the quick selection of an engine timing parameter in degrees in an advanced or retarded setting being easily accomplished by counting the same number of orifices in the upper and lower portions equal to the quantity of degrees of engine timing. The orifices are counted from the zero degree orifice in the same advanced or retarded directions as engine timing, then aligned and interlocked via an index screw inserted through the threaded upper member orifice and into a portion of the aligned, threaded lower member orifice.

The present invention provides an adjustable interlocking ignition rotor device comprising a first member having a plurality of orifices radially positioned around the axis of said first member; a second member having a plurality of orifices radially positioned around the axis of said second member; means for securing said second member to a rotating member; means for aligning predetermined orifices in said first and second members; means for interlocking said first member to said second member; and means for setting the timing of an engine by aligning preselected orifices in said first and second members.

BRIEF DESCRIPTION OF DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
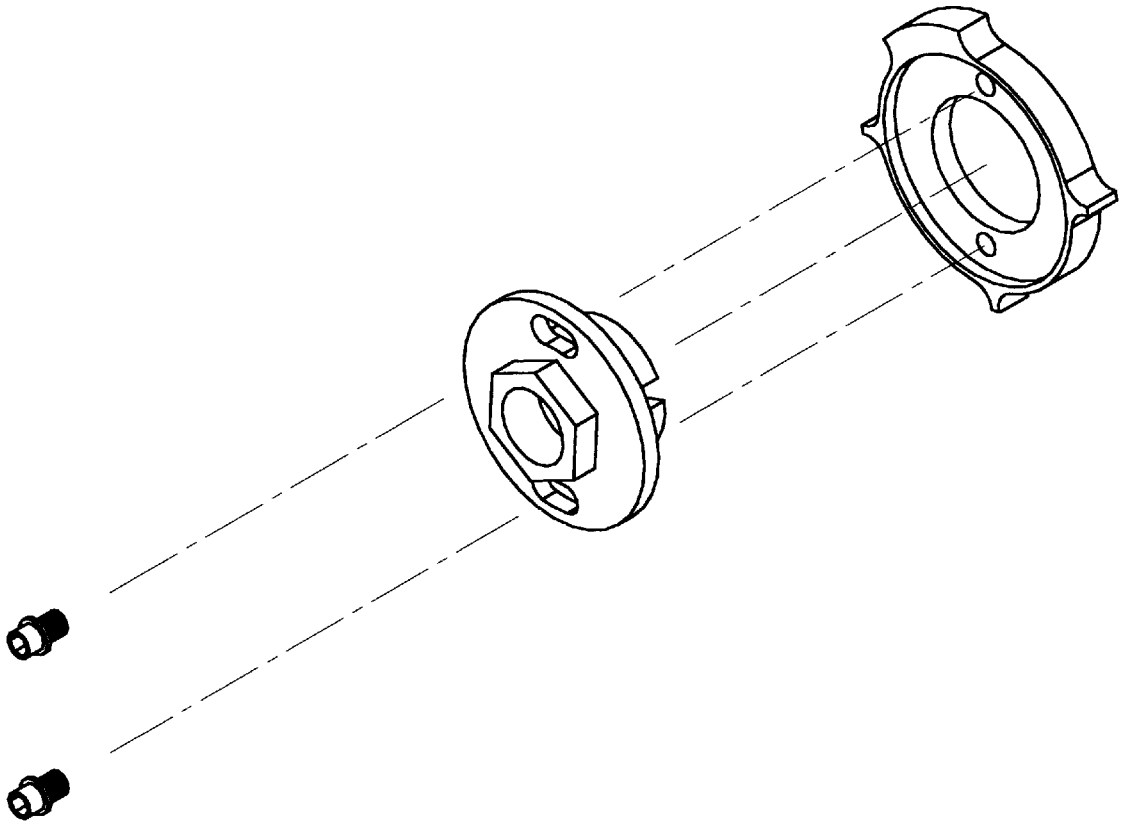
PRIOR ART FIG. 1
FIG. 1 is an exploded, top, right perspective view of a prior art adjustable rotor ignition rotor device.
Figure 2:
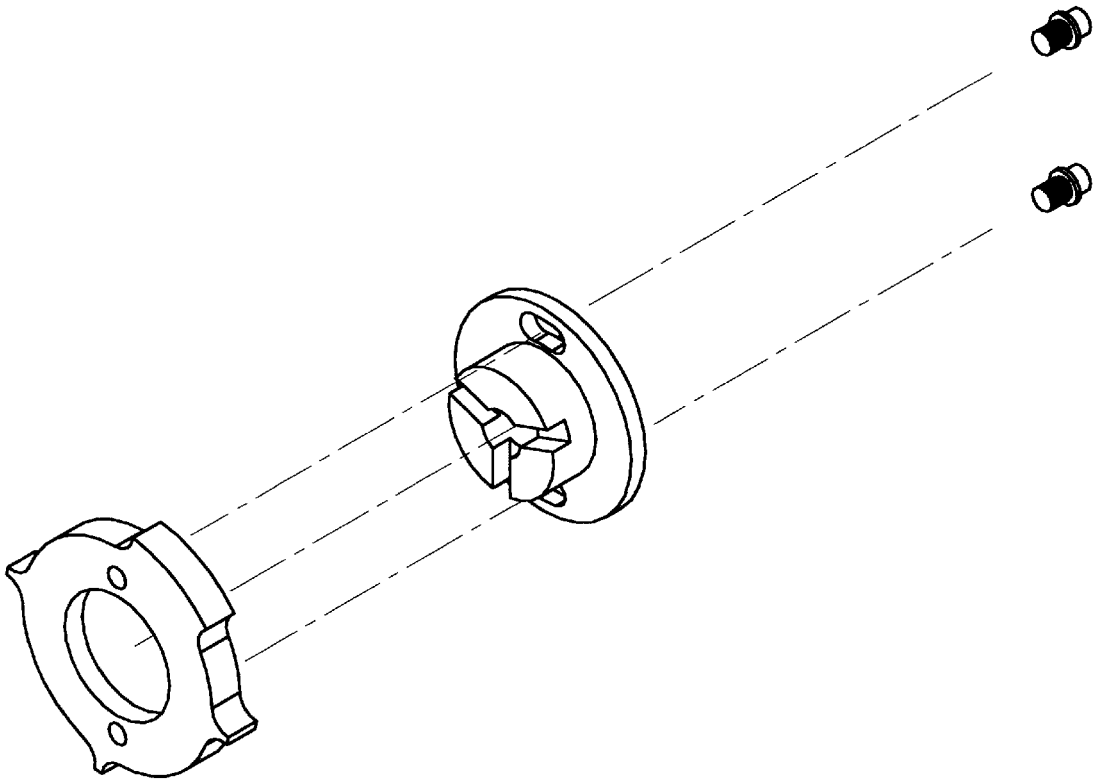
PRIOR ART FIG. 2
FIG. 2 is an exploded, bottom, right perspective view of the prior art adjustable ignition rotor device.
Figure 3:
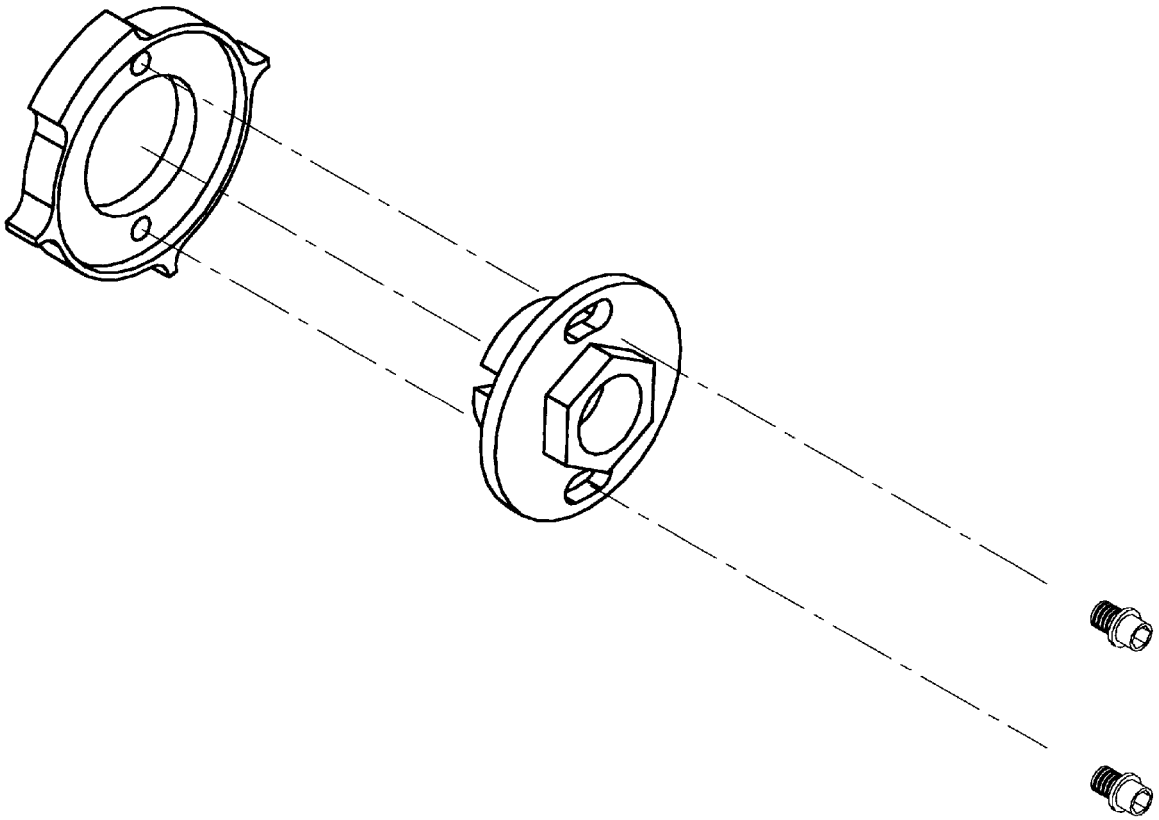
PRIOR ART FIG. 3
FIG. 3 is an exploded, top, left perspective view of the prior art device.
Figure 4:
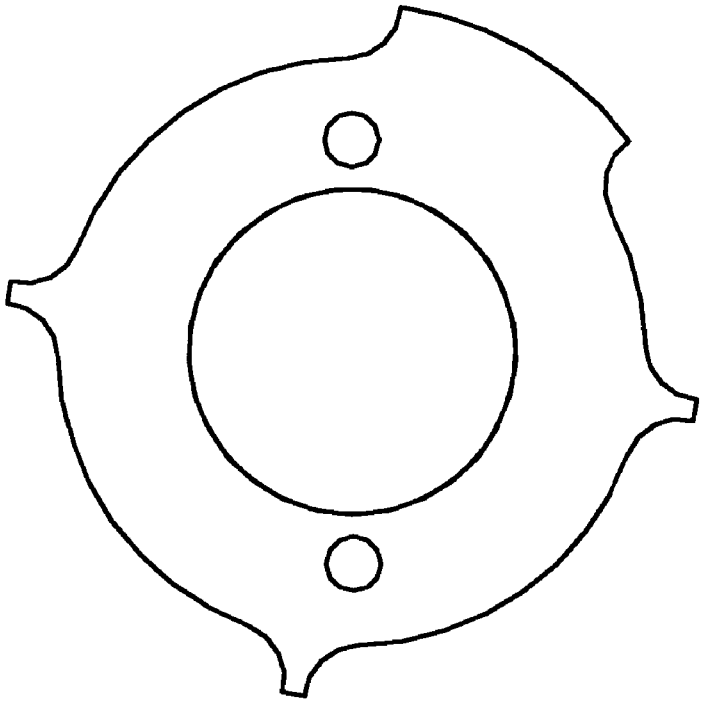
PRIOR ART FIG. 4
FIG. 4 is an bottom view of the bottom portion of the prior art device.
Figure 5:
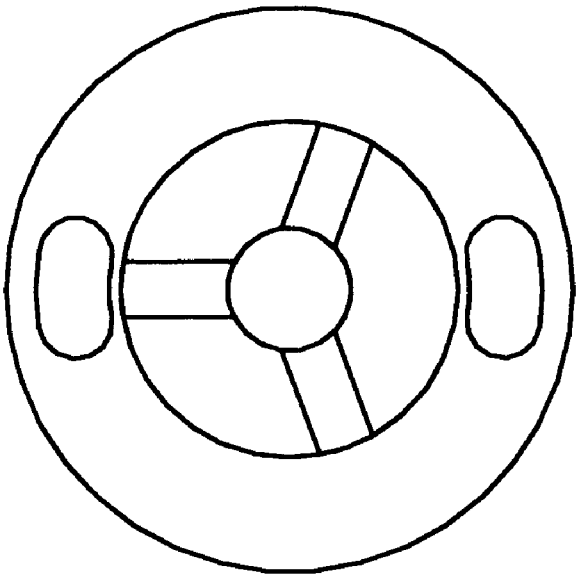
PRIOR ART FIG. 5
FIG. 5 is a bottom view of the upper portion of the prior art device.
Figure 6:
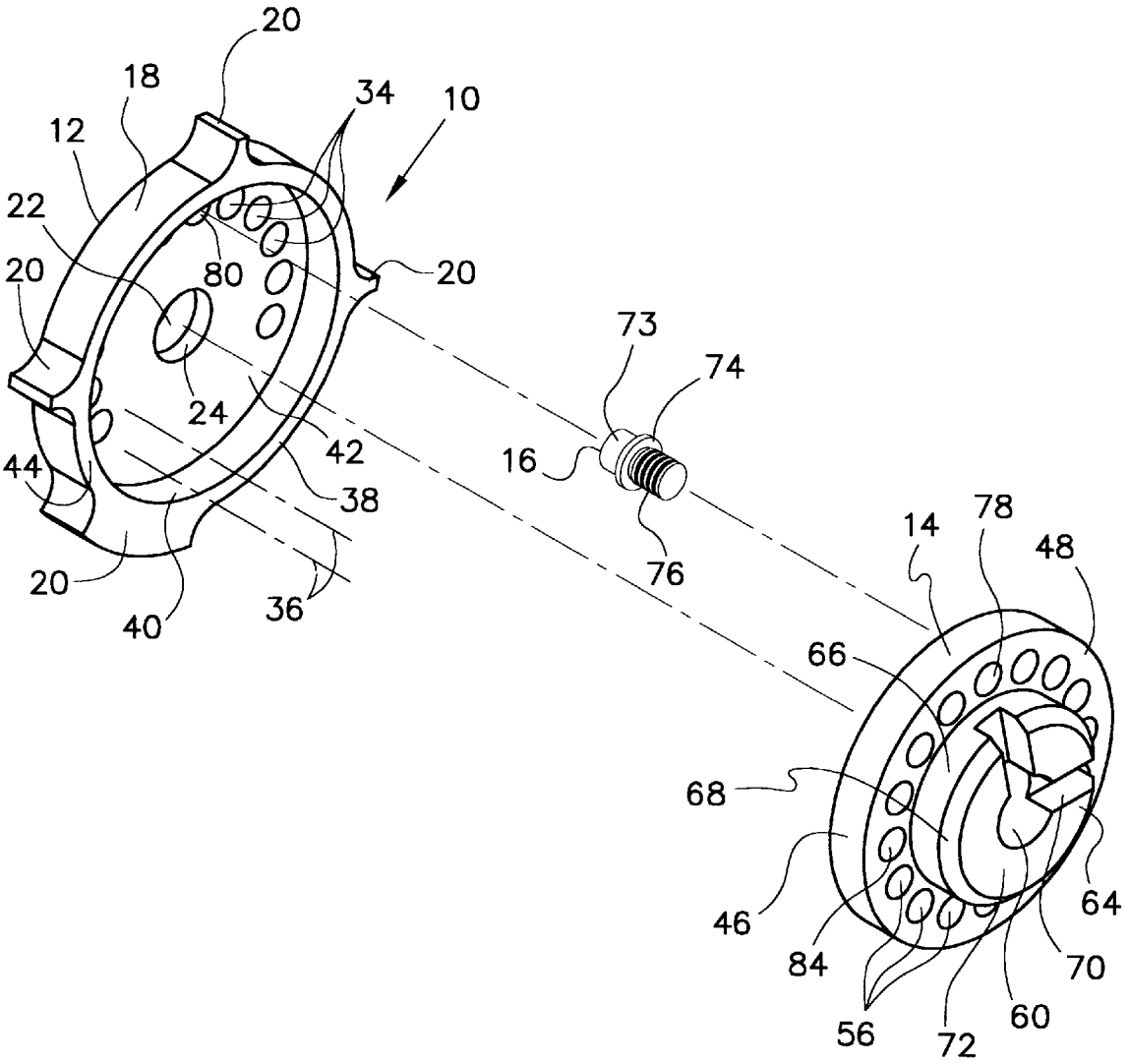
FIG. 6 is an exploded, bottom, left perspective view of an adjustable interlocking ignition rotor device in accordance with the present invention.

Referring now to the figures and in particular to FIGS. 6 (an exploded bottom perspective) and 7 (an exploded top perspective view) of an adjustable interlocking ignition rotor device in accordance with the present invention is denoted by numeral 10. The device 10 includes a first member 12, a second member 14 and an index screw 16 to secure a preselected position of the first member 12 in relation to the second member 14.

The first and second member 12 and 14 and the index screw 16 may be fabricated from a myriad of metals including but not limited to brass, aluminum, stainless steel and carbon steel. Irrespective of the metal of choice, an important characteristic of the chosen metal is a substantial rigidity that prevents deformation when experiencing high vibrations generated by an internal combustion engine.

The device 10 may be attached to one end of a crankshaft or camshaft when used to control the timing of a motorcycle engine. Also, the device is included in a distributor assembly that sets the timing for firing ignition systems that ignite the combustible mixture in the cylinder of an internal combustion engine. A distributor is generally used in automobiles having multiple cylinders in the internal combustion engine. The device 10 may also be used to control the timing of fuel injection into a diesel engine which does not use spark plugs to ignite a combustible mixture.

The first member 12 includes a generally cylindrical outer wall 18 having finger grips 20 protruding therefrom for enhanced finger rotation of the first member 12 when engaging the second member 14 and a distributor shaft on a locking device such as a bolt which protrudes through the central orifice 22 configured from a cylindrical inner wall 24 of the first member 12.

The first member 12 includes a hexagonal nut 26, that facilitates the rotating of a crankshaft or similar rotating member that receives the device 10, integrally joined to an upper planar wall 28. The nut has an inner cylindrical wall 30 relatively larger in diameter than the central orifice 12 thereby forming an inner base 32 or ridge to act as a "stopper" for a portion of the distributor shaft, crankshaft or similar rotating member engaging the first member 12. The nut 26 is designed to removably receive a portion of the distributor shaft or locking device having a hexagonal configuration slightly larger than the nut 26 thereby securing the position of the distributor shaft or locking device in relation to the position of the nut 26.

The first member 12 includes a plurality of orifices 34 in the upper wall 28 having equal diameters and positioned an equal radial distance around the axis of the first member 12. The orifices 34 are annularly configured and have equal diameters and parallel axes 36 with an equal distance 'd' separating each adjacent pair of axes 36. Although the preferred embodiment has the orifices being equal in diameter with equal radial spacing; alternatively, the orifice diameters and the radial distances around the axis could all be varied. However, varying these dimensions would force the reconfiguration of the device 10 which would prevent the substitution of the device 10 for a prior art ignition rotor.

Referring to FIG. 6, a recess 38 is depicted in the first member 12 configured by an inner cylindrical wall 40 and a planar lower wall 42. The diameter of recess 38 establishes a relatively thin annular rim wall 44 configured by the respective diameter dimensions of the outer cylindrical wall 18 and inner cylindrical wall 40 of the first member 12. The depth of the recess being established by the distance between the parallel, planar rim and lower walls 44 and 42 of the first member 12.

Figure 7:
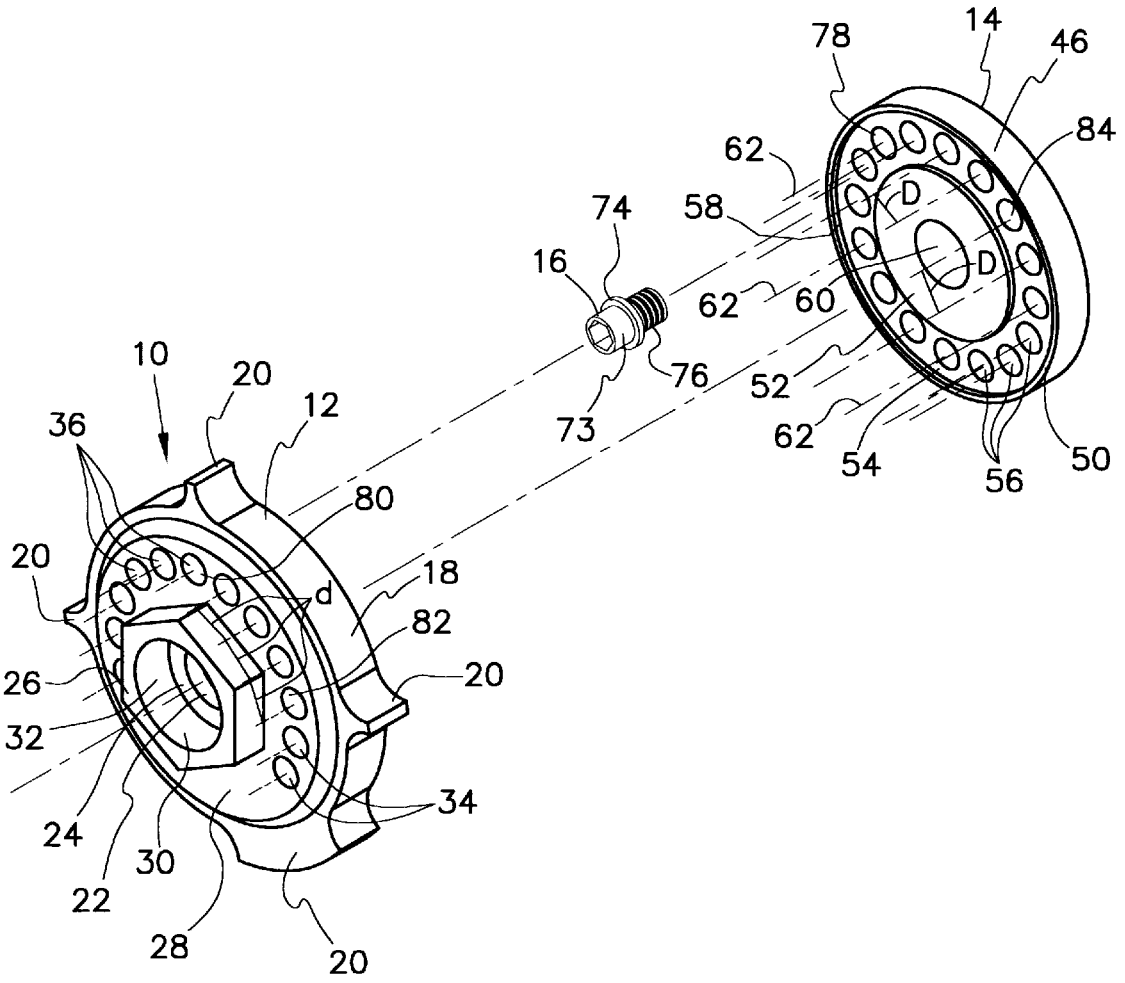
FIG. 7 is an exploded, top, right perspective view of an adjustable interlocking ignition rotor device in accordance with the present invention.
Figure 8:
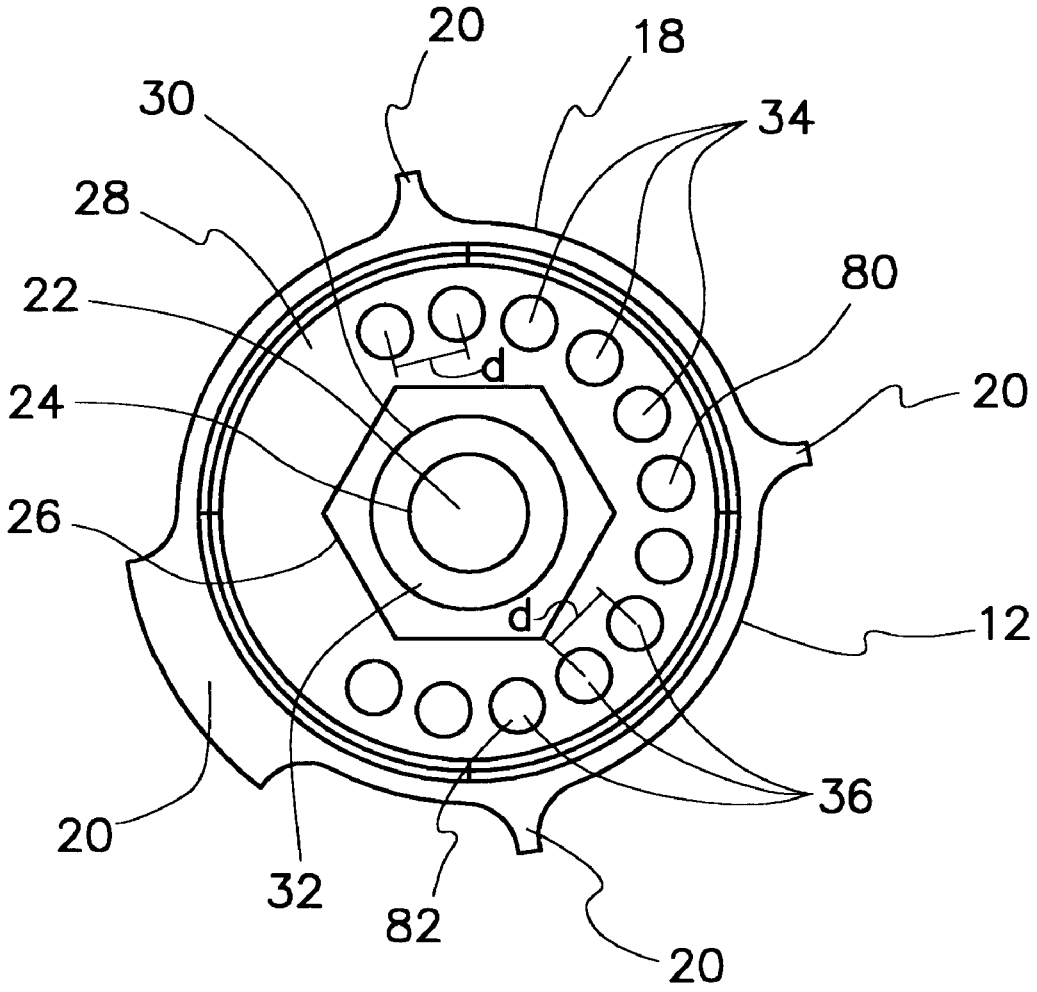
FIG. 8 is a top view of the first member depicted in FIG. 7.
Figure 9:
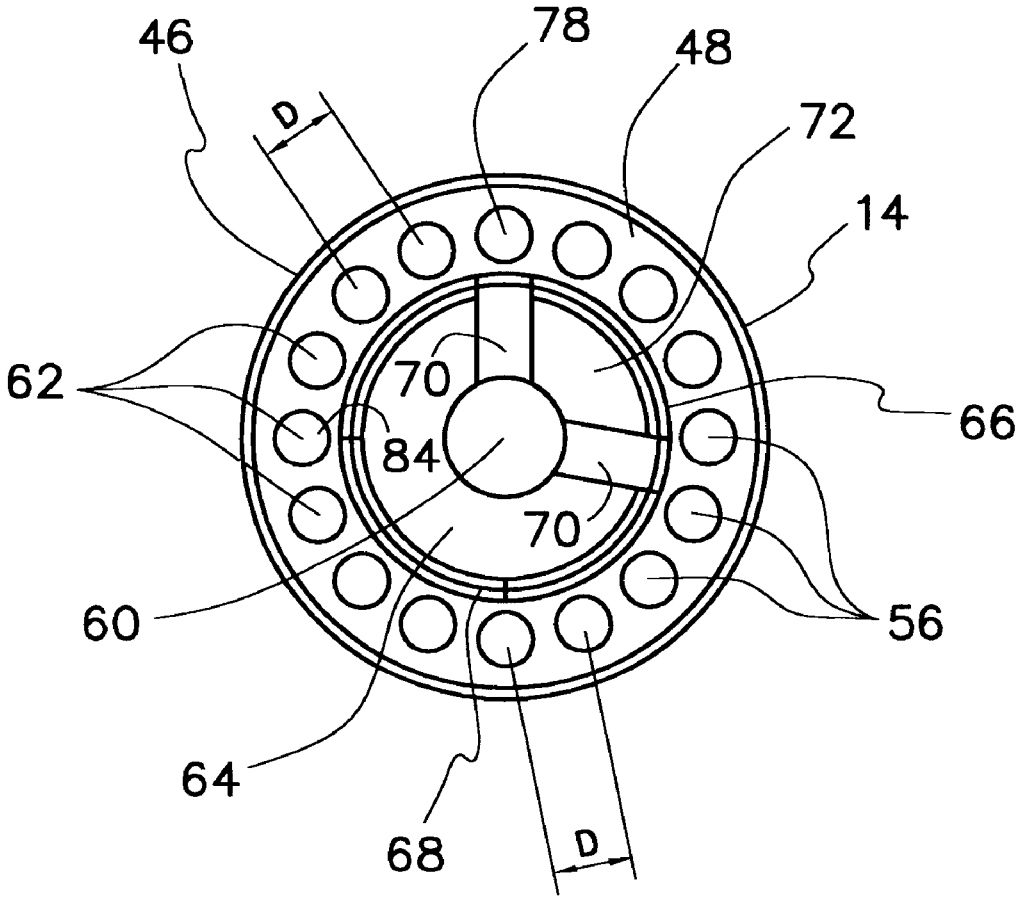
FIG. 9 is a bottom view of the second member depicted in FIG. 6.

Referring to FIG. 7, the second member 13 includes a generally cylindrical outer side wall 46 having a diameter slightly smaller than the diameter of the recess 38 in the first member 12. The thickness of the outer side wall 46 is defined by the distance between a planar, annular lower wall 48 and a parallel planar, annular rim wall 50. The configuration and dimensioning of the cylindrical outer wall 46 being predetermined by the configuration and dimensioning of the recess 38 in the first member 12, to allow the second member 14 to snugly insert into the recess 38 such that the lower wall 48 of the second member 14 is parallel and planar with the rim wall 44 of the first member 12.

The second member 14 further includes an upper annular wall 52 that is planar and parallel with the annular rim wall 52, and an annular recess 54 separating the rim and upper walls 50 and 52 a distance sufficient to drill and tap a plurality of orifices 56 with equal diameters between two vertical walls 58 forming the recess 54. Although the first and second member 12 and 14 orifices are described as being threaded, alternatively, the device will operate with only the second member 14 having threaded orifices. The index screw 16 would insert through the first member 12 and screw into the second member 14 faster. However, the index screw 16 would be easily lost when removing the screw from the second member 14 without the first member 12 being threaded.

The diameters of the orifices 56 in the second member 14 are equal to the diameters of the orifices 34 in the first member 12. The orifices 56 in the second member 14 are positioned an equal radial distance around the axis of the second member 14. The orifices 56 are annularly configured and have equal diameters and parallel axes 62 with a distance 'D' separating each pair of adjacent axes 62. The distance 'D' is preselected to correspond to predetermined increments of engine timing, both in the advance and retard directions. The distance 'D' separating the orifices 56 of the second member 14, is slightly larger than the distance 'd' separating the orifices 36 of the first member 12 thereby providing the feature to allow only one orifice 36 in the first member 12 and one orifice 56 in the second member 14 to be aligned. Thus, no other orifices in the two members 12 and 14 will align after aligning one orifice 34 in the first member 12 with one orifice 56 in the second member 14. The device 10 would still operate if more than two orifices aligned in the first and second members 12 and 14. The present device 10 is designed to provide quick adjustment of engine timing, an important feature in competitive auto and motorcycle racing. Knowing the correct degree setting of engine timing when viewing the device 10, and the amount of variation required for a new timing setting, provides for a faster adjustment in timing and a corresponding reduced time to prepare a vehicle for competitive racing.

Figure 10:
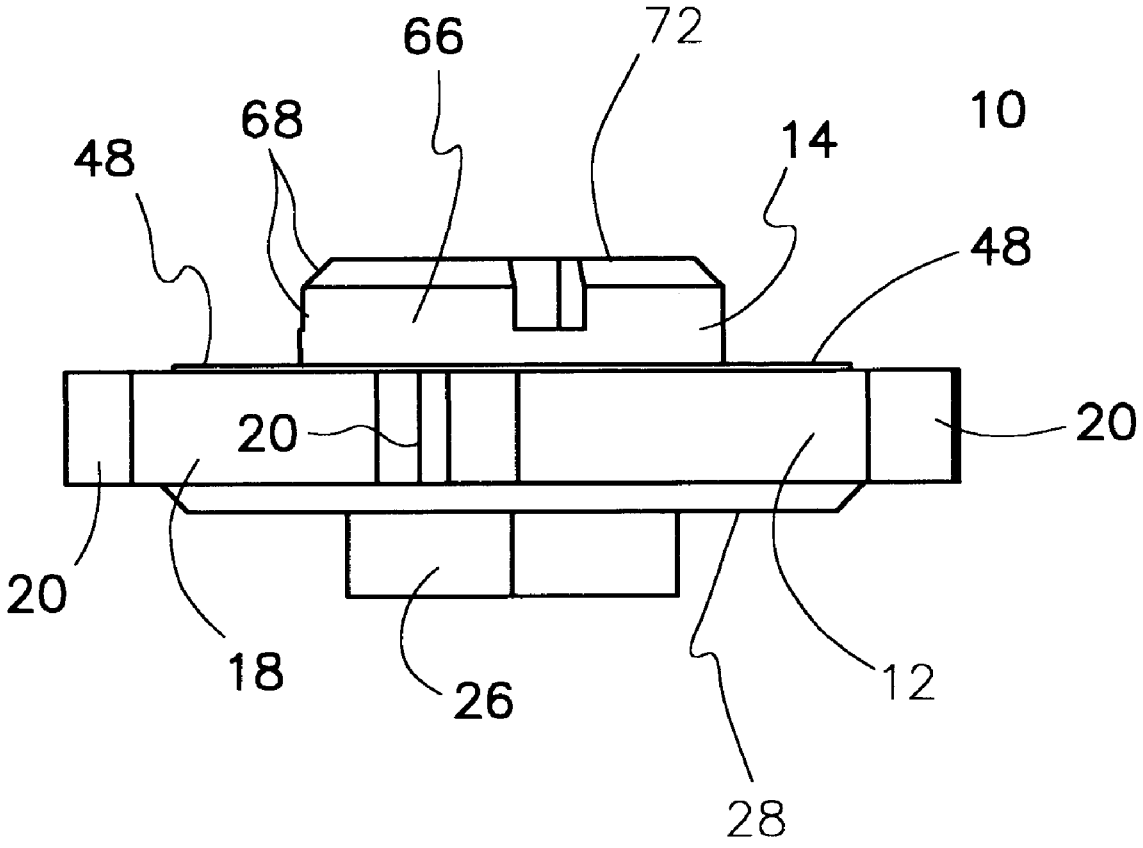
FIG. 10 is a side elevation view of the device with the first and second members interlocked together in accordance with the present invention.

Referring to FIGS. 6 and 10, a cylindrically configured engagement portion 64 protrudes longitudinally and coaxially from the planar lower wall 48 of the second member 14. The engagement portion 64 includes a cylindrical outer side wall 66 having a diameter substantially the same as the diameter of the oppositely positioned upper planar wall 52 thereby positioning the perimeters of the upper wall 52 and side wall 66 adjacent to the orifices 56.

The engagement portion 64 further includes a frustoconically configured seating portion 68 having a "V" shaped channel or indexing slots 70 therein to interlock with a corresponding distributor base portion or pin secured to the end of a crankshaft to prevent rotational movement between the interlocking component and the second member 14. The seating portion 68 includes an annular, planar lower wall 72 that sets upon a corresponding distributor base portion or crankshaft end, and the central orifice 60 that allows the distributor shaft to protrude through the second member 14.

The index screw 16 is tightened via a gripping portion 73, through an orifice 34 in the first member 12 and into an aligned orifice 56 in the second member 14 a predetermined distance established by a relatively small annular stopping ridge 74. The stopping ridge 74 prevents the threaded portion 76 of the set screw 16 from extending completely through the second member 14 and scratching the distributor base portion of the distributor assembly. Further, if only the second member 14 has threaded orifices, and with the orifices of the first member 12 being slightly larger than the orifices of the second member 14, the index screw 16 would have a shoulder in place of the ridge 74. The shoulder would be slightly larger in diameter than the second member orifices. The shoulder of the index screw 16 would allow the insertion of the screw 16 into the second member 14 to a predetermined distance. The shoulder portion would insert into the orifice of the first member 12 thereby allowing the index screw 16 to be flush with or countersunk below the upper wall 28 of the first member 12.

Both aligned orifices 34 and 56 are threaded to insure that the index screw 16, once extracted enough to allow the first member 12 to rotate upon the second member 14, will not be dropped and cause possible engine failure. Further, to provide for easier insertion of the set screw 16 into an orifice 56 in the second member 14 after the set screw 16 is inserted through an orifice 34 in the first member 12, the recess 54 separates adjacently positioned recesses 34 and 56 sufficiently to allow a person to "feel" the unseen orifice 56 in the second member 14 into which the person is attempting to insert the set screw 16.

In operation, an adjustable interlocking ignition rotor device 10, dimensioned to replace an ignition rotor adjusted via set screws and arcuate slots, is installed in a rotor assembly utilized to set the timing for an engine used to power an automobile or motorcycle. The device 10 includes a second member 14 that removably receives a distributor shaft or locking out through a central orifice 60 in the second member 14. The second member 14 interlocks with a base portion of the distributor assembly or a pin in one end of a crankshaft thereby securing the position of the second member 14. A plurality of threaded orifices 56 are positioned an equal radial distance around the axis of the second member 14 such that the distance separating the axes of each adjacently positioned pair of orifices 56 is a constant distance 'D'. The device 10 could operate with distance 'D' not being constant, however, the time to adjust the device 10 would increase.

The distance 'D' is a preselected measurement corresponding to engine timing in predetermined degree increment variations from a zero degree starting reference in a positive or negative direction, i.e. advance or retard directions. One degree timing variations is standard for the industry; however, larger or smaller degreed timing variations may be selected which will require a corresponding larger or smaller distance 'D' to be determined for separating the axes of adjacent orifices 56 in the second member 14.

Upon selecting the required distance 'D' between the axes of the second member 14 orifices 56, the smaller distance 'd' separating adjacent axes of the orifices 34 in the first member 12, must be determined. Before distance 'd' is calculated, an orifice 78 in the second member 14 must be determined that has a position that corresponds to a zero degree timing setting for the engine. Next, an orifice 80 in the first member 12 must be selected to align with the zero degree timing orifice 78 in the second member 14. The zero timing orifice in the first member 12 selected, is generally an orifice in the middle of the multiple orifices 34.

The distance 'd' is then calculated to allow only one orifice 34 in the first member 12 to align with one orifice 56 in the second member 14 irrespective of which orifices 34 and 56 in the first and second members 12 and 14 are selected. Further, the distance 'd' must be calculated that will cause a preselected orifice 34 in the first member 12, offset from the zero degree orifice 80 a preselected quantity of orifices, when aligned with an orifice 56 in the second member 14 also offset from the zero degree orifice 78 the same preselected quantity of orifices, to adjust the timing of an engine a corresponding quantity of degrees equal to the quantity of orifices offset from the zero degree orifice.

For example, if an engine needs to have a timing setting of four degrees in the advanced position, the fourth orifice 82 in a clockwise direction, when taking a top view of the device (FIG. 7), in the first member 12 is aligned with the fourth orifice 84 in a clockwise direction in the second member 14. The relative positions of the fourth orifices 82 and 84 are interlocked by screwing the index screw 16 through the aligned fourth orifices 82 and 84 to a tightened position with the fourth orifices 82 and 84 aligned, no other orifices 34 and 56 in the first and second members 12 and 14 will be aligned sufficiently to allow a setscrew 16 to be screwed into an orifice 56 in the second member 14.

Upon securing the preselected positions of the first and second members 12 and 14, the timing of the firing of the engine spark plugs is set to correspond to a predetermined optimal position of the engine pistons inside the cylinders.

Obviously, many modifications and variations of the present invention are possible in light of the above teachings. Thus, it is to be understood that within the scope of the appended claims, the invention may be practiced otherwise than as specifically described above.

What is claimed and desired to be secured by Letters Patent of the United States is:

1. An adjustable interlocking ignition rotor device comprising:

a first member having a plurality of orifices radially positioned around the axis of said first member;

a second member having a plurality of orifices radially positioned around the axis of said second member;

means for securing said second member to a rotating member;

means for aligning predetermined orifices in said first and second members;

means for joining said first member to said second member; and means for setting the timing of an engine by aligning preselected orifices in said first and second members.

2. The device of claim 1 wherein said first member includes a cylindrically configured inner wall to receive a distributor shaft therethrough, a cylindrically configured outer wall defining a perimeter that inserts in a distributor base, and a cylindrical recess corresponding to the configuration of said second member.

3. The device of claim 1 wherein said second member includes a cylindrically configured inner wall to receive a distributor shaft therethrough, and a cylindrically configured outer wall defining a perimeter to snugly insert in said cylindrical recess in said first member.

4. The device of claim 1 wherein said aligning means includes radially positioning said orifices in said first and second members such that the axes of said orifices are spaced an equal radial distance from and parallel to said distributor shaft axis.

5. The device of claim 1 wherein said aligning means includes positioning said orifices in said first member such that the axes of said orifices are circumferentially spaced a first dimension.

6. The device of claim 1 wherein said aligning means includes means for positioning said orifices in said second member such that the axes of said orifices are circumferentially spaced a second dimension.

7. The device of claims 5 or 6 wherein said first and second dimensions are predetermined to allow only one pair of orifices in said first and second members to be aligned thereby precluding alignment between all remaining orifices in said first and second members.

8. The device of claim 1 wherein said aligning means includes a centering orifice in each of said first and second members to establish a zero degree timing set point for said engine when said centering orifices are aligned.

9. The device of claim 1 wherein said joining means includes a threaded inner wall in each orifice in said first and second members, and a set screw inserted through aligned orifices in said first and second members.

10. The device of claim 1 wherein said timing setting means includes means for selecting said predetermined first and second dimensions to correspond to preselected degree engine timing increments to advance or retard engine timing.

11. The device of claim 1 wherein said timing setting means includes means for selecting said predetermined first and second dimensions to position said orifices in said first and second members such that one preselected orifice in each first and second member is offset from said zero degree orifices a quantity of orifices in the same advance or retard timing directions, said offset from said zero degree orifices corresponds to advancing or retarding engine timing a quantity of degrees corresponding to said quantity of orifices offset from said zero degree orifices.

12. A method for adjustably interlocking an ignition rotor comprising the steps of:

providing a first member having a plurality of orifices radially positioned around the axis of a distributor shaft;

providing a second member having a plurality of orifices radially positioned around the axis of said distributor shaft;

securing said first member to a rotating member;

aligning predetermined orifices in said first and second members;

joining said second member to said first member, and setting the timing of an engine by aligning preselected orifices in said first and second members.

13. An adjustable interlocking ignition rotor device comprising:

a first member having a plurality of orifices radially positioned around the axis of said first member;

a second member having a plurality of orifices radially positioned around the axis of said second member;

means for securing said second member to a rotating member;

means for aligning preselected orifices in said first and second members;

means for joining said first member to said second member; and means for setting the timing of an engine corresponding to said preselected orifices in said first and second members.

* * * * *